US011242986B2

(12) United States Patent
Liu et al.

(10) Patent No.: US 11,242,986 B2
(45) Date of Patent: Feb. 8, 2022

(54) LIGHTING APPARATUS

(71) Applicant: XIAMEN LEEDARSON LIGHTING CO., LTD, Fujian (CN)

(72) Inventors: Anyong Liu, Fujian (CN); Shouqiang Hou, Fujian (CN); Yongzhe Dong, Fujian (CN); Xiaoliang Wen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/013,528

(22) Filed: Sep. 4, 2020

(65) Prior Publication Data

US 2021/0071857 A1 Mar. 11, 2021

(30) Foreign Application Priority Data

Sep. 6, 2019 (CN) ..... 201921484075.6
Sep. 6, 2019 (CN) ..... 201921484157.0
Sep. 6, 2019 (CN) ..... 201921484173.X

(51) Int. Cl.

| | |
|---|---|
| ***F21V 23/04*** | (2006.01) |
| ***F21V 23/00*** | (2015.01) |
| ***H01H 17/02*** | (2006.01) |
| ***H01H 3/02*** | (2006.01) |
| ***F21Y 113/10*** | (2016.01) |
| ***F21Y 115/10*** | (2016.01) |
| ***F21Y 103/37*** | (2016.01) |
| ***F21V 3/00*** | (2015.01) |
| ***F21Y 105/14*** | (2016.01) |

(52) U.S. Cl.

CPC ..... *F21V 23/0435* (2013.01); *F21V 23/009* (2013.01); *F21V 23/04* (2013.01); *H01H 3/02* (2013.01); *H01H 17/02* (2013.01); *F21V 3/00* (2013.01); *F21Y 2103/37* (2016.08); *F21Y 2105/14* (2016.08); *F21Y 2113/10* (2016.08); *F21Y 2115/10* (2016.08)

(58) Field of Classification Search

CPC ..... F21Y 2103/37; F21Y 2105/14
USPC ..... 439/431
See application file for complete search history.

(56) References Cited

U.S. PATENT DOCUMENTS 4,743,724 A * 5/1988 Goodwin, Jr. ..... H01H 23/141 200/331
5,495,402 A * 2/1996 Houssian ..... F21S 8/035 362/186
9,894,740 B1 * 2/2018 Liszt ..... F21V 7/0008
(Continued)

*Primary Examiner* — Alan B Cariaso
(74) *Attorney, Agent, or Firm* — Chun-Ming Shih; Lanway IPR Services

(57) ABSTRACT

A lighting apparatus includes a light source, a driver, a light housing, an actuator unit, a light passing cover, and an external switch. The driver is used for converting an external power to a driving current supplied to the light source. The light housing is used for disposing the light source and the driver. The actuator unit is connected the driver for configuring a working status of the driver. The light passing cover is fixed to the light housing for a light of the light source to pass through. The external switch is mechanically connected to the actuator via a through hole of the light passing cover for the actuator to generate a control message to the driver. The driver controls the light source according to the control message to configure the working status of the light source.

19 Claims, 11 Drawing Sheets

(56) References Cited

U.S. PATENT DOCUMENTS

| | | | | |
|---|---|---|---|---|
| 2016/0047537 | A1* | 2/2016 | Stolte | F21V 23/0435<br>362/276 |
| 2018/0003351 | A1* | 1/2018 | Van Winkle | F21S 4/10 |
| 2020/0248898 | A1* | 8/2020 | Chen | H05B 47/115 |

* cited by examiner

LIGHTING APPARATUS

FIELD

The present invention is related to a lighting apparatus, and more particularly related to a configurable lighting apparatus.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People always expect more advancement, more functions, more flexibility in their products. It is the same in the design of lighting devices.

Therefore, it is beneficial to design a flexible, easy to configure light device for enhancing human life, providing more convenience and technical effect. People always expect more advancement, more functions, more flexibility in their products. It is the same in the design of lighting devices.

Therefore, it is beneficial to design a flexible, easy to configure light device for enhancing human life, providing more convenience and technical effect.

SUMMARY

In some embodiments, a lighting apparatus includes a light source, a driver, a light housing, an actuator unit, a light passing cover, and an external switch.

The driver is used for converting an external power to a driving current supplied to the light source. The light housing is used for disposing the light source and the driver. The actuator unit is connected to the driver for configuring a working status of the driver.

The light passing cover is fixed to the light housing for a light of the light source to pass through. The external switch is mechanically connected to the actuator via a through hole of the light passing cover for the actuator to generate a control message to the driver.

The driver controls the light source according to the control message to configure the working status of the light source.

Specifically, users operate the external switch. The external switch is connected to the actuator, e.g. a lever, a sliding switch, a control circuit board, or a sensor.

In the following embodiments, there are several embodiment options for designing the external switch.

The actuator is therefore indirectly operated to generate a control message to the driver to change a working status of the driver.

There are various ways for designing the control message mentioned here. For example, the actuator may actively generate a mechanical status change or an electronic signal to the driver as the control message. In some other embodiments, the driver may detect the status of the actuator, e.g.

an offset adjustment value, a rotation value, a force applied on the actuator or other design that makes the driver communicating with the actuator so as the driver accordingly determines a configuration of the driver on controlling the light source.

The light source may include one or more LED modules. The LED modules may be controlled to change their output depending on different working statuses.

For example, a first working status may be associated with a cool color temperature while a second working status may be associated with a warm color temperature. The multiple LED modules may have different types of LED chips or the same LED chips covered with different fluorescent layers so as to emit different lights. When the driver separately controls the multiple LED modules for changing their output parameters, different mixed light effect may be achieved.

In some embodiments, the external switch is a pull string with a first portion disposed at an inner side of the light passing cover and a second portion disposed at an exterior side of the light passing cover.

Specifically, the pull string may be made of textile material, elastic spring material, metal or plastic material, one or multiple strings.

For example, two or more than two pull strings are prepared so that each pull string or their combination of operation may be associated with different settings.

A portion of the pull string is placed inside the light passing cover while another portion of the pull string is placed outside the light passing cover. The pull string may be inserted via an opening of the light passing cover.

The light passing cover may be transparent, translucent or be designed as a diffusion layer, which diffuses and soften light output of the lighting apparatus.

To enhance the structural strength, a cap may be attached to the light passing cover for passing through the pull string.

In some embodiments, an electronic component is attached to the pull string.

The electronic component receives power supply from the driver.

In some embodiments, the pull string may be attached or embedded with one or more electronic component.

For example, the pull string may include an electrical wire, a sensor, a switch, a light device, an antenna or even a processor as the electronic component.

For example, when the antenna is placed on the pull string, particularly at a position outside the light passing cover, a better signal quality is achieved if the driver contains a wireless circuit that needs the antenna to communicate with other devices.

When the antenna is placed outside the light passing cover, signal is not influenced by the light passing cover and kept away from other heat-generating or electro-magnetic wave generating components, thus making signal transmission or receiving quality being enhanced.

In some embodiments, the pull string includes an electrical wire and may have a connector for connecting an electronic device.

The electronic device may be fixed or detachably connected to the driver.

In some embodiments, the electronic component is a light device with power supplied by the driver.

In some embodiments, the electronic component may be a light device, e.g. a LED indicator with lower strength compared with the light source concealed by the light housing and the light passing cover.

This is particularly helpful in the deep night while the light device on the pull string is taken as a night light providing weak but comfortable light strength in the night.

The light device receives power supply from the driver.

In some embodiments, the pull string may have a socket like an USB socket for connecting to a battery bank when in emergent situation.

There are more variations may be applied based on the innovative concept mentioned above.

In some embodiments, the electronic component is a detachable remote control detachable from the pull string.

When the detachable remote control is detached from the pull string, the remote control sends the control message to the driver via a wireless circuit of the driver.

In some embodiments, the electronic component is a remote control that may be operated directly on the pull string. In some embodiments, the electronic component may be further detached when necessary to be used as a remote control.

In other words, the remote control may be attached on the pull string to prevent missing. In some cases, when users want to do so, the remote control may be detached form the lighting apparatus and uses wireless communication to change the working status of the driver.

In some embodiments, the pull string has a connector at the exterior side of the light passing cover.

The connector is detachably connected to an external device and supplies power generated by the driver to the external device.

In some embodiments, the pull string has a connector at the exterior side of the light passing cover.

The connector is detachably connected to an external device and supplies power generated by the driver to the external device.

In some embodiments, the driver includes a driver box and a driver circuit.

The actuator is a lever connected to a mechanical switch of the driver circuit.

Specifically, the driver may include a driver circuit board. There is a mechanical switch disposed on the driver circuit board. The mechanical switch may be structurally connected to the actuator, e.g. a lever for sliding or moving the mechanical switch to change a working status of the driver.

In some embodiments, a top end of the pull string is fixed to the lever.

The pull string has a top end and a bottom end. The top end is fixed to the actuator and the bottom end is exposed outside the light passing cover for a user to pull to change a configuration of the driver.

In some embodiments, an opaque unit is used for fixing the top end of the pull string to the lever and covers a through hole for inserting the pull string.

The opaque may be an elastic unit that is deforms during assembly and recovers to original shape when an external force is released.

When the elastic unit is opaque, the opaque unit prevents light exiting from a through hole for passing the pull string.

In some embodiments, the light source includes multiple types of LED modules.

The multiple types of LED modules have different optical parameters, the driver control the multiple types of LED modules to mix a mixed light corresponding to the working status.

In some embodiments, the multiple types of LED modules have different color temperatures.

In some embodiments, the light source includes multiple light module respectively electrically connected to the driver.

The light module has a U-shape plate mounted with multiple LED modules.

The U-shape plate has a first arm, a second arm and a connection part.

The first arm and the second arm are connected at opposite ends of the connector part.

In some embodiments, the first arm has a longer length than the second arm.

In some embodiments, the U-shape plates are fixed to a back cover of the light housing.

In some embodiments, the U-shape plates are disposed surrounding the driver.

In some embodiments, the second arm of one U-shape plate has a light source connector plugged to a driver connector of the driver for electrically connecting the LED modules on said one U-shape plate to the driver.

In some embodiments, the external switch includes a rotation button for a user to rotate the rotation button to configure the working status of the driver.

In some embodiments, the external switch includes a pressing button for a user to press the button to configure the working status of the driver.

In some embodiments, a back cover of the light housing has a first reflective layer for reflecting the light of the light source to the light passing cover.

The first reflective layer has a central opening for placing the driver.

In some embodiments, the light housing has a lateral wall connected to a peripheral edge of the back cover.

A second reflective layer is attached to an inner surface of the lateral wall.

DETAILED DESCRIPTION

Figure 11:
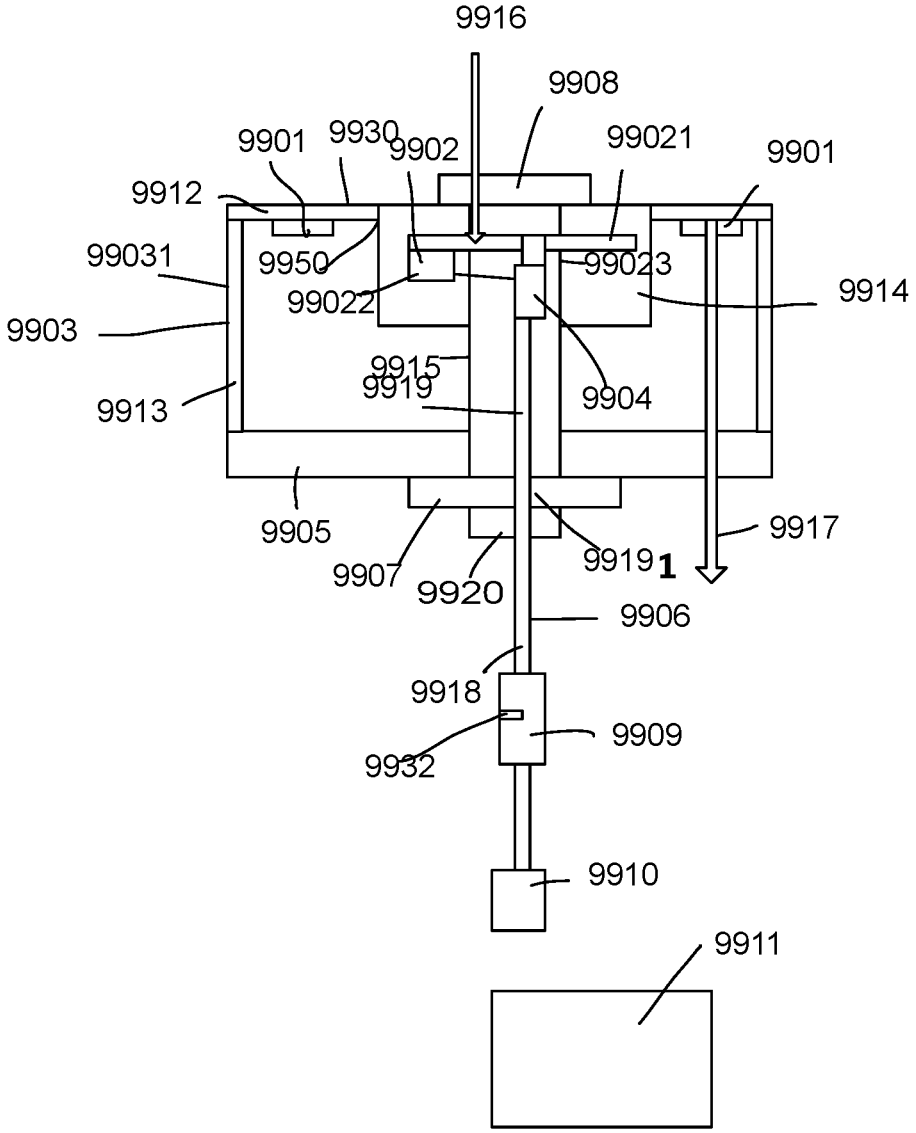
FIG. 11 shows an embodiment diagram.

In FIG. 11, a lighting apparatus includes a light source 9901, a driver 9902, a light housing 9903, an actuator unit 9904, a light passing cover 9905, and an external switch 9906.

The driver 9902 is used for converting an external power 9916 to a driving current supplied to the light source 9901.

The light housing 9903 is used for disposing the light source 9901 and the driver 9902. The actuator unit 9904 is connected the driver 9902 for configuring a working status of the driver 9902.

The light passing cover 9905 is fixed to the light housing 9903 for a light 9917 of the light source 9901 to pass through. The external switch 9906 is mechanically connected to the actuator 9904 via a through hole as an opening 99191 of the light passing cover 9905 for the actuator to generate a control message to the driver 9902.

The driver 9902 controls the light source 9901 according to the control message to configure the working status of the light source 9901.

Specifically, users operate the external switch 9906. The external switch 9906 is connected to the actuator 9904, e.g. a lever, a sliding switch, a control circuit board, or a sensor. Users may pull, rotate, press, touch or perform one or more operations on the external switch to change the working status of the driver 9902.

In the following embodiments, there are several embodiment options for designing the external switch.

The actuator is therefore indirectly operated to generate a control message to the driver to change a working status of the driver.

There are various ways for designing the control message mentioned here. For example, the actuator may actively generate a mechanical status change or an electronic signal to the driver as the control message. In some other embodiments, the driver may detect the status of the actuator, e.g. an offset adjustment value, a rotation value, a force applied on the actuator or other design that makes the driver communicating with the actuator so as the driver accordingly determines a configuration of the driver on controlling the light source.

Figure 12:
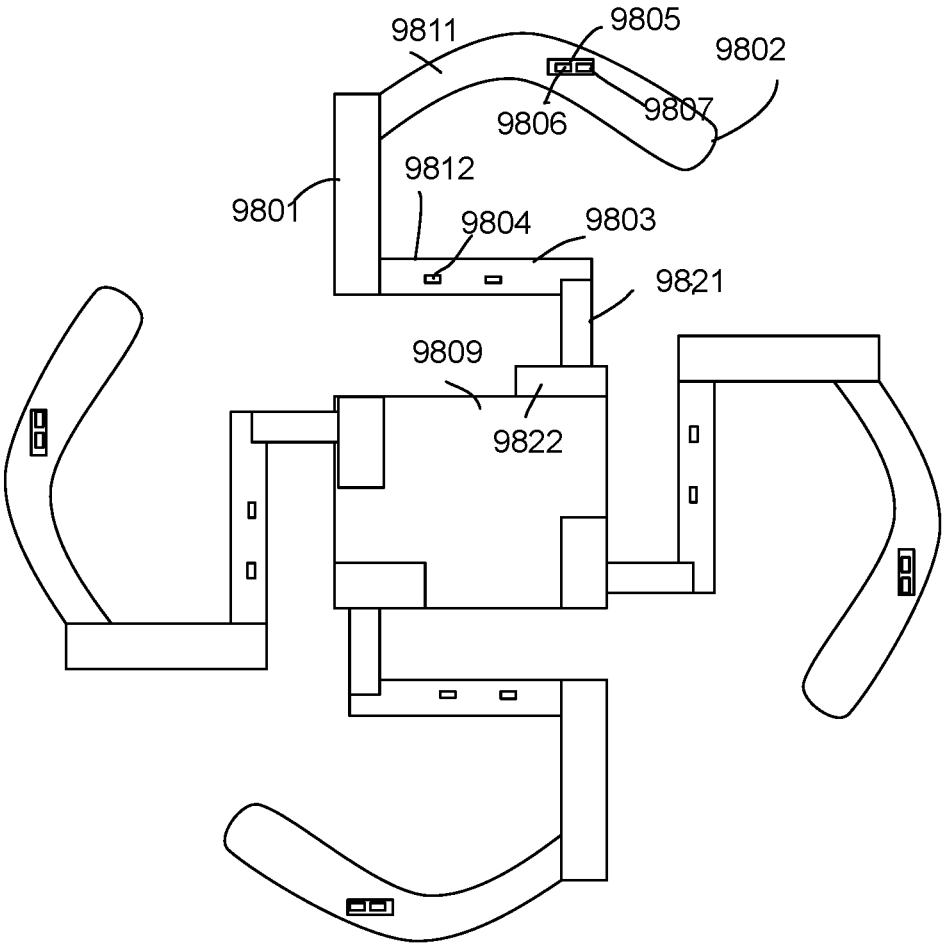
FIG. 12 shows a light source example.

FIG. 12 illustrates a light source example. The light source may include one or more LED modules 9806, 9807. The LED modules 9806, 9807 may be controlled to change their output depending on different working statuses of the driver 9809.

For example, a first working status may be associated with a cool color temperature while a second working status may be associated with a warm color temperature. The multiple LED modules may have different types of LED chips or the same LED chips covered with different fluorescent layers so as to emit different lights. When the driver separately controls the multiple LED modules for changing their output parameters, different mixed light effect may be achieved.

In some embodiments, the external switch 9906 is a pull string with a first portion 9919 disposed at an inner side of the light passing cover 9905 and a second portion 9918 disposed at an exterior side of the light passing cover 9905.

In some embodiments, the actuator 9904 may protrude outside the light passing cover 9905 to engage the external switch 9906 outside the light passing cover 9905.

Specifically, the pull string may be made of textile material, elastic spring material, metal or plastic material, one or multiple strings.

For example, two or more than two pull strings are prepared so that each pull string or their combination of operation may be associated with different settings. When one pull string example is illustrated, persons of ordinary skilled in the art would know how to place two pull strings for pulling one actuator unit or two parts of the same actuator unit. Their drawings are not provided for brevity.

A portion 9919 of the pull string is placed inside the light passing cover while another portion 9918 of the pull string is placed outside the light passing cover 9905. The pull string may be inserted via an opening 99191 of the light passing cover.

The light passing cover may be transparent, translucent or be designed as a diffusion layer, which diffuses and soften light output of the lighting apparatus.

To enhance the structural strength, a cap 9920 may be attached to the light passing cover for passing through the pull string.

In the example of FIG. 11, a column 9915 has a first end connected to the cap 9907 and has a second end connected to another cap 9908. The driver 9902 has a driver box 9914 with a central hole for the column 9915 to pass through. By using such design, the components, including the light passing cover 9905, the light housing 9903, a back cover 9930 of the light housing 9903, the driver 9902 are fixed together with the simple but elegant design.

In some embodiments, an electronic component 9909 is attached to the pull string.

The electronic component 9909 receives power supply from the driver 9902.

In some embodiments, the pull string may be attached or embedded with one or more electronic component 9909.

For example, the pull string may include an electrical wire, a sensor, a switch, a light device, an antenna or even a processor as the electronic component.

For example, when the antenna 9932 is placed on the pull string, particularly at a position outside the light passing cover 9905, a better signal quality is achieved if the driver contains a wireless circuit that needs the antenna to communicate with other devices.

When the antenna is placed outside the light passing cover, signal is not influenced by the light passing cover and kept away from other heat-generating or electro-magnetic wave generating components, thus making signal transmission or receiving quality being enhanced.

In some embodiments, the pull string includes an electrical wire and may have a connector 9910 for connecting an electronic device 9911.

The electronic device 9911 may be fixed or detachably connected to the driver 9902. The electronic device 9911 may be used for send a user command to the driver 9902. In some other embodiments, the electronic device 9911 may be a function module adding a function to the driver 9902. For example, the electronic device 9911 may include a sensor, a processor, a speaker, a camera, a battery or other function unit.

In some embodiments, the electronic component 9909 is a light device with power supplied by the driver.

In some embodiments, the electronic component may be a light device, e.g. a LED indicator with lower strength compared with the light source concealed by the light housing and the light passing cover.

This is particularly helpful in the deep night while the light device on the pull string is taken as a night light providing weak but comfortable light strength in the night.

The light device receives power supply from the driver.

In some embodiments, the pull string may have a socket like an USB socket for connecting to a battery bank when in emergent situation.

There are more variations may be applied based on the innovative concept mentioned above.

In some embodiments, the electronic component is a detachable remote control detachably from the pull string.

When the detachable remote control is detached from the pull string, the remote control sends the control message to the driver via a wireless circuit of the driver.

In some embodiments, the electronic component is a remote control that may be operated directly on the pull string. In some embodiments, the electronic component may be further detached when necessary to be used as a remote control.

In other words, the remote control may be attached on the pull string to prevent missing. In some cases, when users want to do so, the remote control may be detached form the lighting apparatus and uses wireless communication to change the working status of the driver.

In some embodiments, the pull string has a connector at the exterior side of the light passing cover.

The connector is detachably connected to an external device and supplies power generated by the driver to the external device.

In some embodiments, the pull string has a connector at the exterior side of the light passing cover.

The connector is detachably connected to an external device and supplies power generated by the driver to the external device.

In some embodiments, the driver includes a driver box 9914 and a driver circuit 99022.

The actuator is a lever connected to a mechanical switch of the driver circuit.

Specifically, the driver may include a driver circuit board 99021. There is a mechanical switch 99023 disposed on the driver circuit board 99021. The mechanical switch 99023 may be structurally connected to the actuator unit 9904, e.g. a lever for sliding or moving the mechanical switch to change a working status of the driver.

In some embodiments, a top end of the pull string is fixed to the lever.

The pull string has a top end and a bottom end. The top end is fixed to the actuator and the bottom end is exposed outside the light passing cover for a user to pull to change a configuration of the driver.

In some embodiments, an opaque unit is used for fixing the top end of the pull string to the lever and covers a through hole for inserting the pull string.

Figure 6:
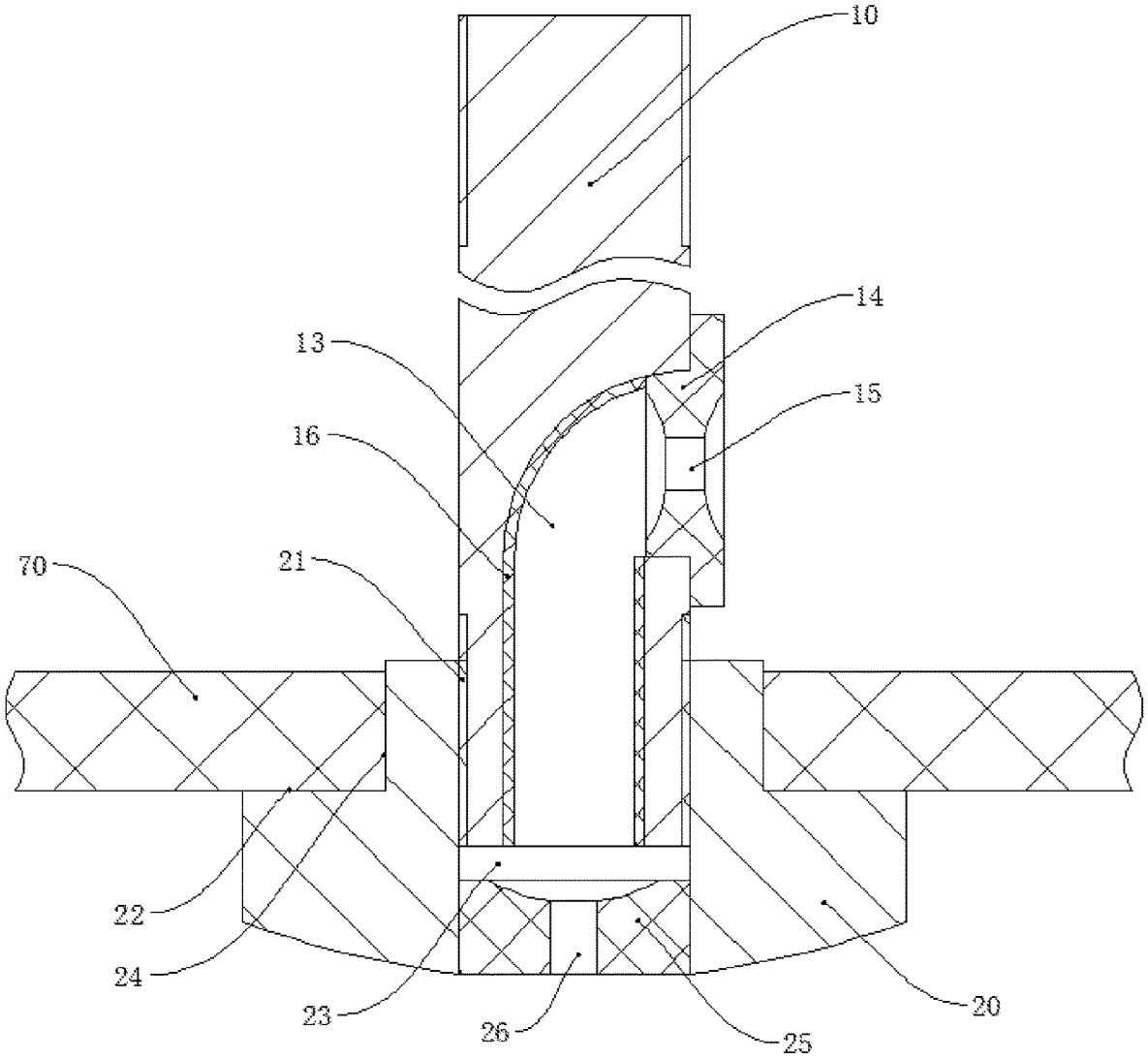
FIG. 6 illustrates another view of a component example.

The opaque may be an elastic unit 14 in FIG. 6 that is deforms during assembly and recovers to original shape when an external force is released.

When the elastic unit is opaque, the opaque unit prevents light exiting from a through hole for passing the pull string.

In FIG. 12, the light source includes multiple types of LED modules 9806, 9807.

The multiple types of LED modules have different optical parameters, the driver control the multiple types of LED modules to mix a mixed light corresponding to the working status.

In some embodiments, the multiple types of LED modules have different color temperatures.

In some embodiments, the light source includes multiple light module 9805, 9803 respectively electrically connected to the driver 9809.

The light module has a U-shape plate mounted with multiple LED modules.

The U-shape plate has a first arm 9811, a second arm 9812 and a connection part 9801.

The first arm 9811 and the second arm 9812 are connected at opposite ends of the connector part 9801.

In some embodiments, the first arm 9811 has a longer length than the second arm 9812. In some embodiments, the first arm 9811 has a curve shape structure corresponding to a peripheral shape of the light passing cover.

In some embodiments, the U-shape plates are fixed to a back cover 9930 of FIG. 11 of the light housing.

In some embodiments, the U-shape plates are disposed surrounding the driver, as illustrated in FIG. 12.

In some embodiments, the second arm of one U-shape plate has a light source connector 9821 plugged to a driver connector 9822 of the driver 9809 for electrically connecting the LED modules on said one U-shape plate to the driver 9809.

Figure 9:
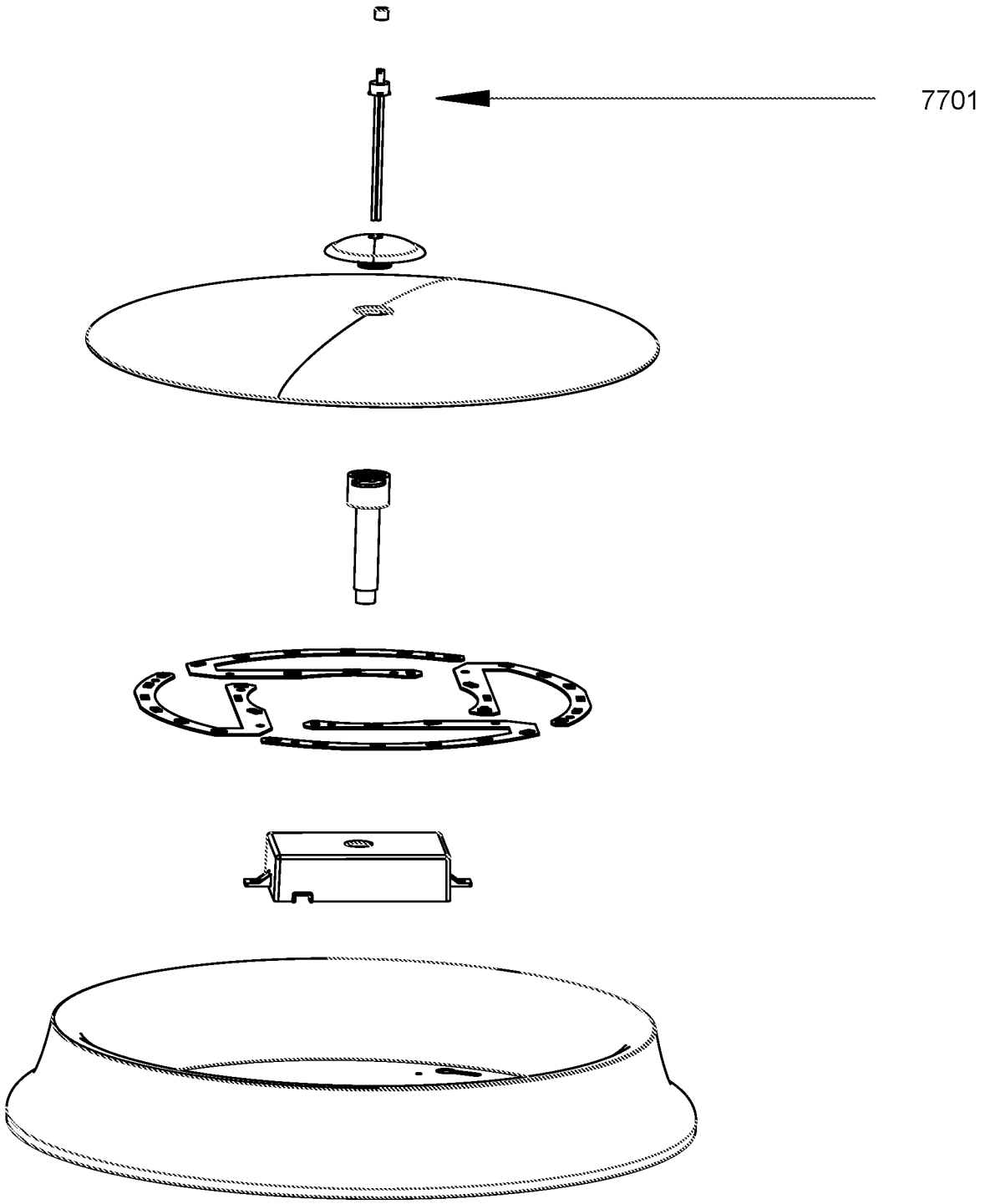
FIG. 9 illustrates another embodiment of a lighting apparatus.

In FIG. 9, the external switch includes a rotation button 7701 for a user to rotate the rotation button to configure the working status of the driver.

Figure 10:
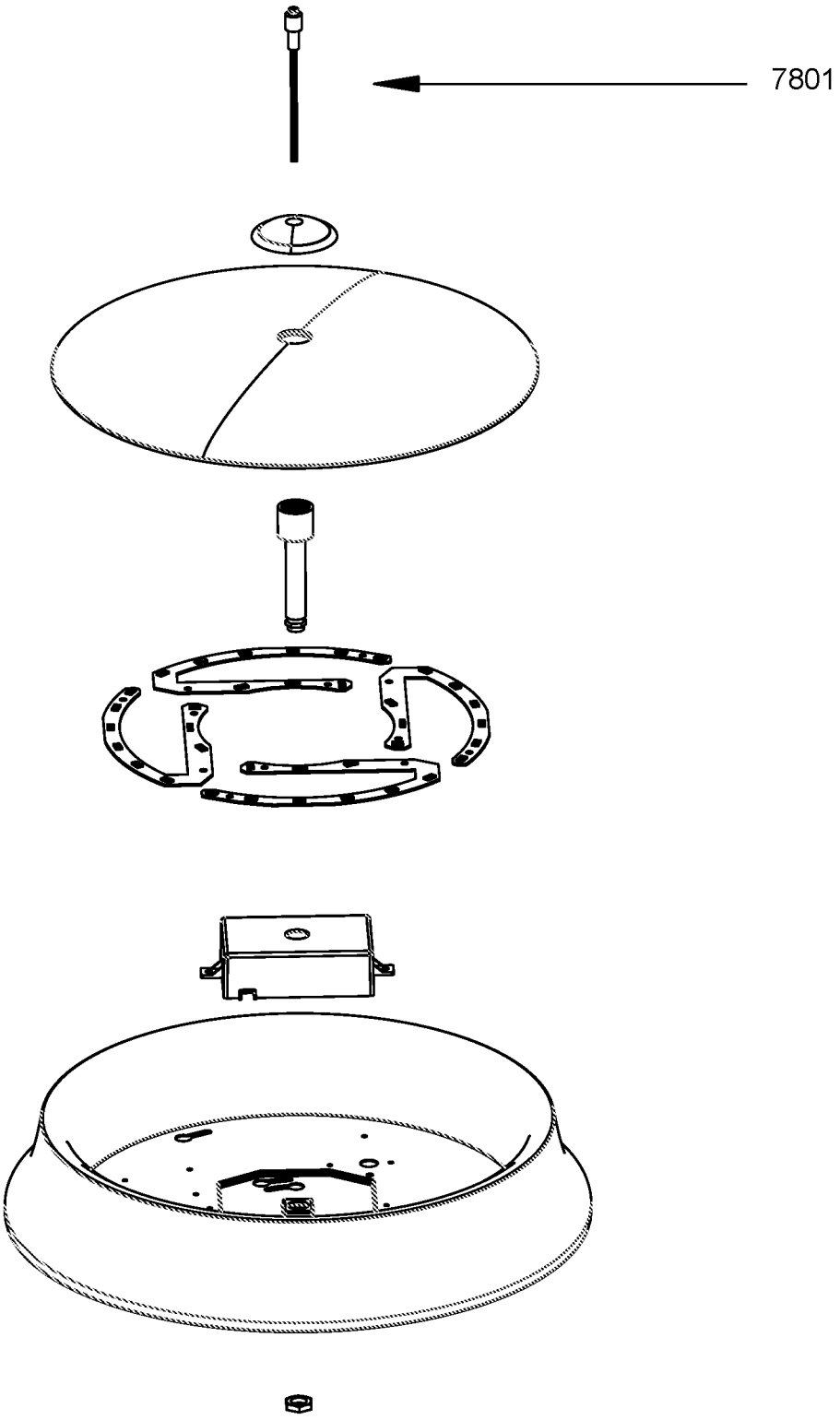
FIG. 10 illustrates another embodiment of a lighting apparatus.

In FIG. 10, the external switch includes a pressing button 7801 for a user to press the button to configure the working status of the driver.

In FIG. 11, a back cover 9930 of the light housing has a first reflective layer 9912 for reflecting the light of the light source to the light passing cover.

The first reflective layer has a central opening 9950 for placing the driver 9902.

In some embodiments, the light housing has a lateral wall 99031 connected to a peripheral edge of the back cover 9930.

A second reflective layer 9913 is attached to an inner surface of the lateral wall 99031.

Figure 1:
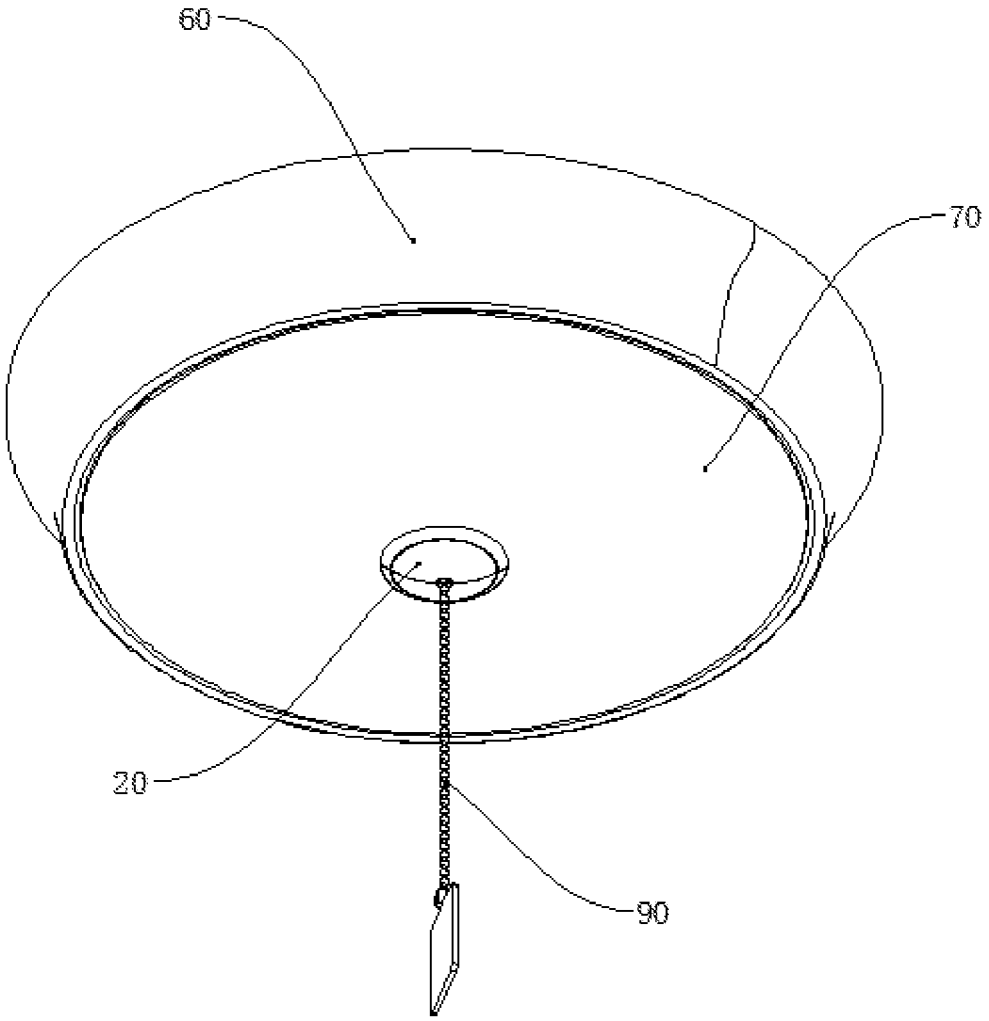
FIG. 1 illustrates a lighting apparatus embodiment.

Please refer to FIG. 1. In FIG. 1, a lighting apparatus embodiment has a light passing cover 70, a light housing 60 and a pull string 90. The light housing 60 has lateral wall as mentioned above. There is a concave shape in the middle part of the lateral wall in this example for better reflecting light more smoothly.

There is a cap 20 as the example mentioned above for fixing a column from one side, and another cap is disposed on the back cover to fix the column at the other side.

Figure 2:
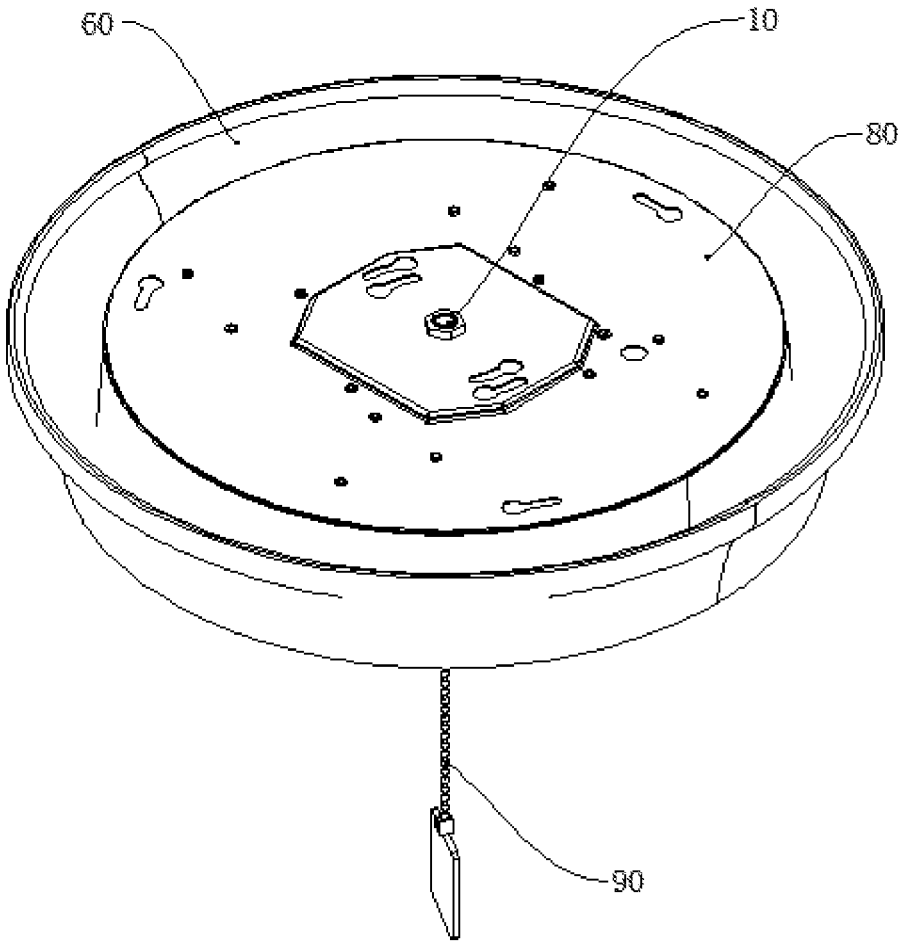
FIG. 2 illustrates another view of the lighting apparatus in FIG. 1.

Please refer to FIG. 2. In FIG. 2, another view of the example in FIG. 1 is illustrated. In the following description, reference numerals with the same values refer to the same components and are not repeated again for brevity.

In FIG. 2, the column 10 pass through the light passing cover, the driver to the other end to be fixed to another cap as mentioned above. A screw structure may be used. The light housing 60 has a back cover 80 with its peripheral edge connected to lateral wall.

Figure 3:
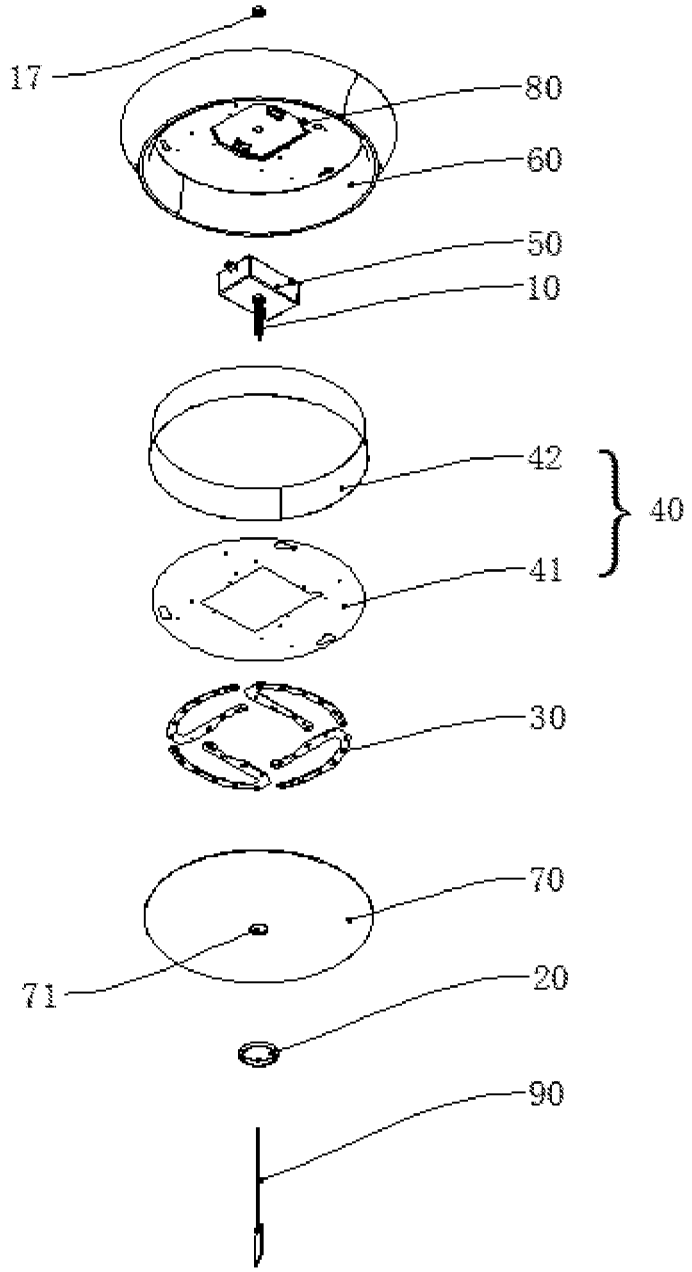
FIG. 3 illustrates an exploded view of the embodiment in FIG. 1.

In FIG. 3, an exploded view of the example of FIG. 2 is provided. The lighting apparatus has a light housing 60 and a back cover 80. Two caps 17, 20 are fixed to two ends of a column 10. The column 10 is used partly as an actuator unit connected to a driver 50.

There is a reflective unit 40. The reflective unit 40 has a first reflective layer 41. The first reflective layer 41 has a central opening surrounding the driver 50. There is a second reflective layer 42. There is a light source 30. There is a light passing cover 70.

There is an opening 71 on the light passing cover 70 for the column 10 to pass through. There is pull string 90.

Figure 4:
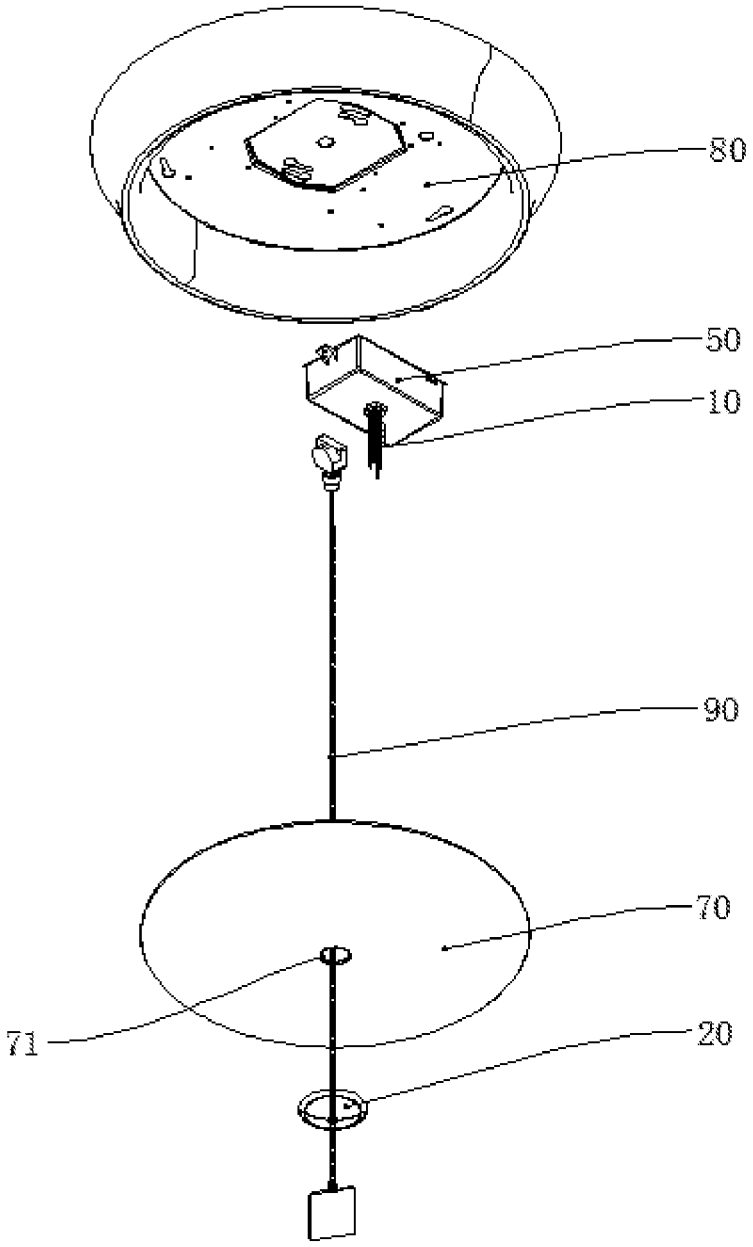
FIG. 4 illustrates another view of a lighting apparatus example.

FIG. 4 shows another view of the example of FIG. 3. The same reference numerals in FIG. 3 refer to the same components in FIG. 4.

Figure 5:
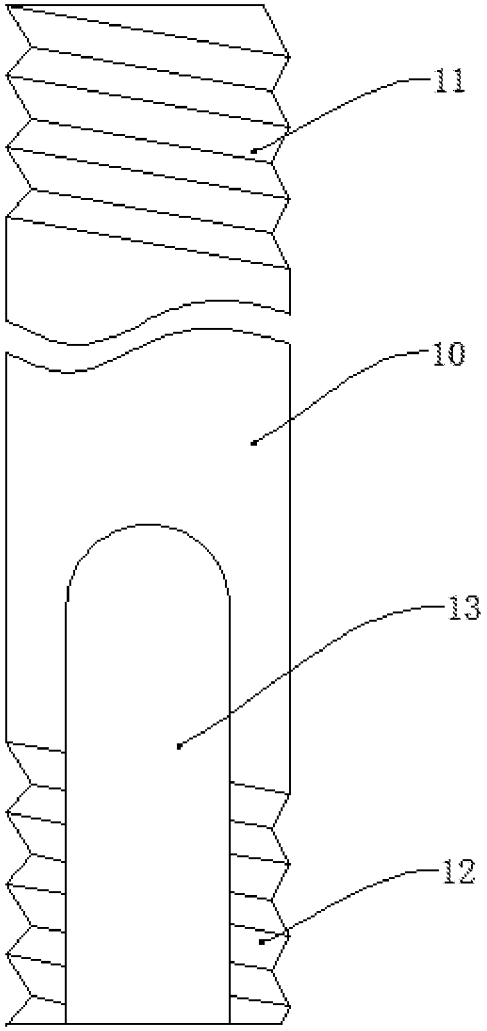
FIG. 5 illustrates a component diagram in an embodiment.

In FIG. 5, the column 10, partly used as the actuator unit, has a first connector part 11 and a second connector part 12. The second connector part 12 has a pull string container 13. The pull string is partly disposed inside the pull string container 13 and fixed to the pull string container.

In FIG. 6, another view is provided showing how to fix the pull string to a column 10. There is an elastic opaque unit 14 used for fixing an end of the pull string, which is passed through a first pull string hole 15.

There is pull string channel 13 for the pull string to move. A flexible layer 16 is embedded inside the pull string channel 13 for lowering sounds when the pull string is moving in the pull string channel 13. The pull string passes through the opening 23, 26. The cap 20 has an elastic concealing cap 25. A water proof unit may be placed in any of connection points 21, 22 of the cap 20 to the light passing cover 70.

Figure 7:
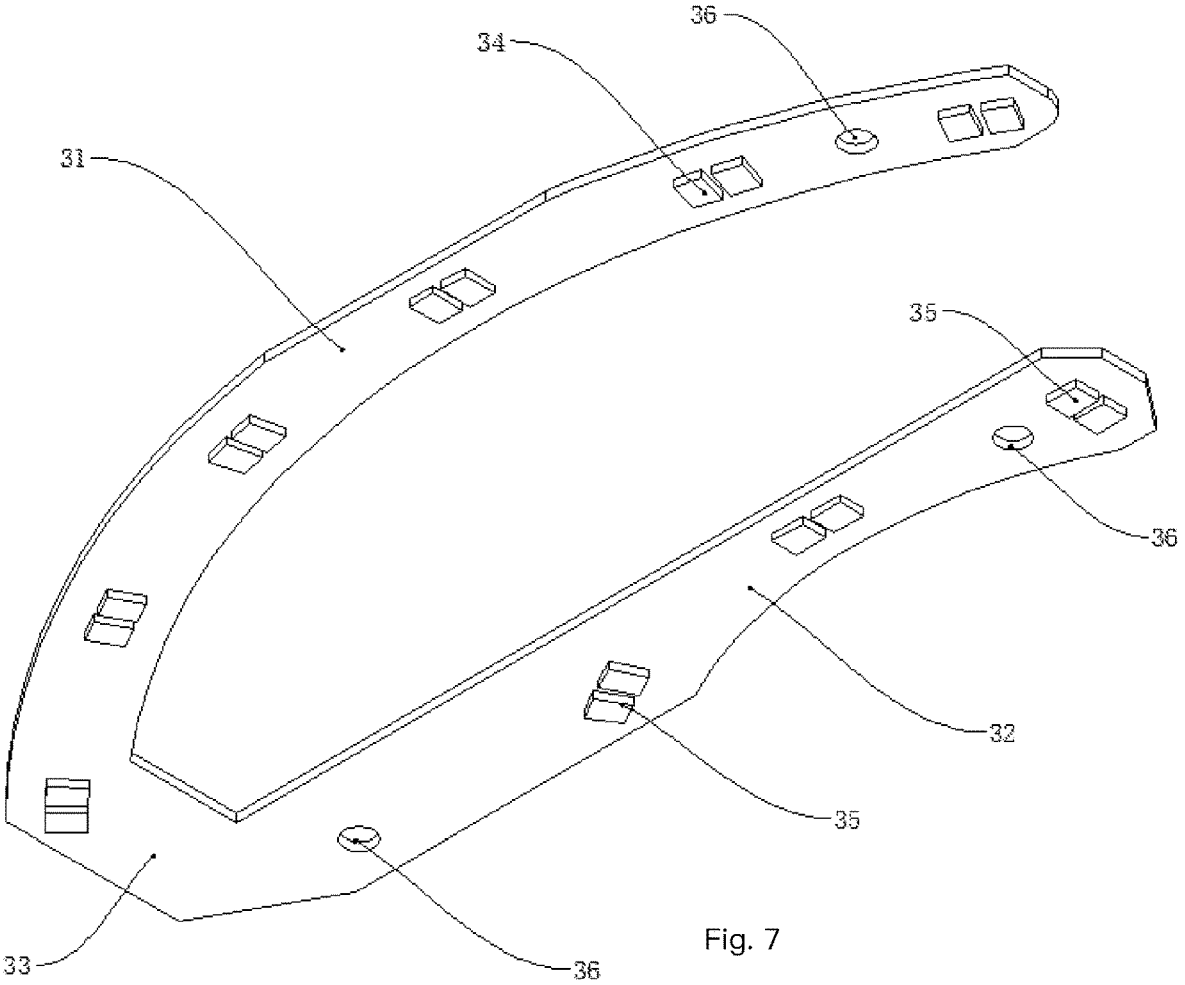
FIG. 7 illustrates a view of a light source example.

In FIG. 7, a U-shape plate is illustrated. There are installation structures 36 like holes for inserting to installation columns or other structures. LED modules 34, 35 are placed on a first arm 31 and a second arm 32. The first arm 31 and the second arm 32 are connected with a connector part 33.

Figure 8:
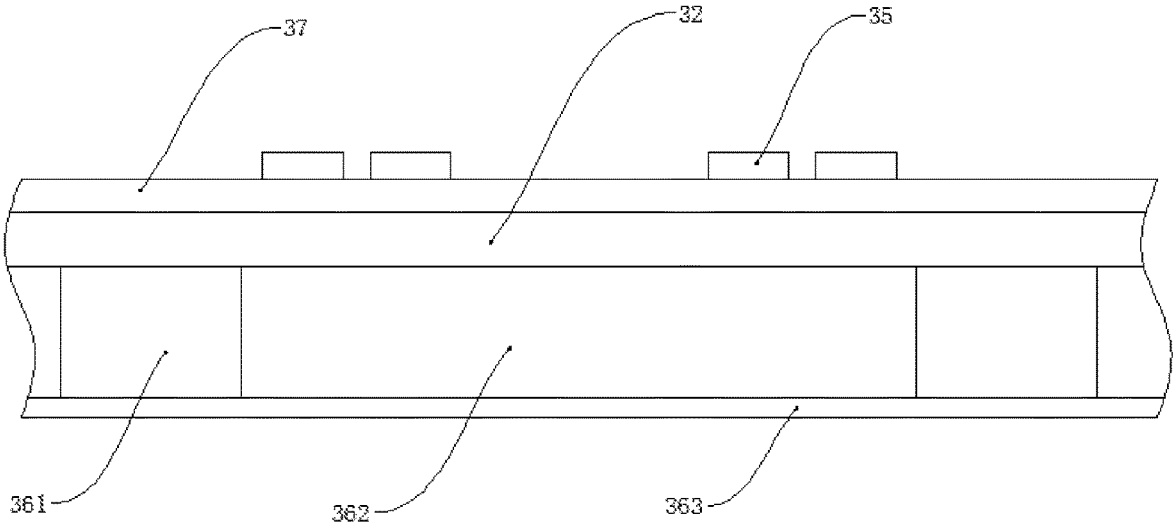
FIG. 8 illustrates a lateral view of a light source example.

In FIG. 8, an adhesive layer 363 is used for attaching the light source to a back cover as mentioned above. There is pad 361 for keeping a distance between the back cover to the light source. There is a supporting bar 362 used for supporting the light source. There is a substrate 32 below a conductive bar 37. The conductive bar 37 brings heat of LED module 35 away to perform heat dissipation.

FIG. 9 shows another embodiment. In this embodiment, the external switch is a rotation button 7701.

FIG. 10 shows another embodiment. In this embodiment, the external switch is a pressing button 7801.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source;

a driver for converting an external power to a driving current supplied to the light source;

a light housing for disposing the light source and the driver;

an actuator unit connected to the driver for configuring a working status of the driver;

a light passing cover fixed to the light housing for a light of the light source to pass through; and an external switch mechanically connected to the actuator unit via a through hole of the light passing cover for the actuator unit to generate a control message to the driver, wherein the driver controls the light source according to the control message to configure the working status of the driver, wherein the light source comprises multiple types of LED modules, the multiple types of LED modules have different optical parameters, the driver control the multiple types of LED modules to mix a mixed light corresponding to the working status.

2. The lighting apparatus of claim 1, wherein the external switch is a pull string with a first portion disposed at an inner side of the light passing cover and a second portion disposed at an exterior side of the light passing cover.

3. The lighting apparatus of claim 2, wherein an electronic component is attached to the pull string, the electronic component receives power supply from the driver.

4. The lighting apparatus of claim 3, wherein the electronic component is a light device with power supplied by the driver.

5. The lighting apparatus of claim 3, wherein the electronic component is a detachable remote control detachable from the pull string, when the detachable remote control is detached from the pull string, the remote control sends the control message to the driver via a wireless circuit of the driver.

6. The lighting apparatus of claim 3, wherein the pull string has a connector at the exterior side of the light passing cover, the connector is detachably connected to an external device and supplies power generated by the driver to the external device.

7. The lighting apparatus of claim 2, wherein the driver comprises a driver box and a driver circuit, the actuator unit is a lever connected to a mechanical switch of the driver circuit.

8. The lighting apparatus of claim 7, wherein a top end of the pull string is fixed to the lever.

9. The lighting apparatus of claim 8, wherein an opaque unit is used for fixing the top end of the pull string to the lever and covers a through hole for inserting the pull string.

10. The lighting apparatus of claim 1, wherein the multiple types of LED modules have different color temperatures.

11. The lighting apparatus of claim 1, wherein the light source comprises multiple light module respectively electrically connected to the driver, the light module has a U-shape plate mounted with multiple LED modules, the U-shape plate has a first arm, a second arm and a connection part, the first arm and the second arm are connected at opposite ends of the connector part.

12. The lighting apparatus of claim 11, wherein the first arm has a longer length than the second arm.

13. The lighting apparatus of claim 11, wherein the U-shape plates are fixed to a back cover of the light housing.

14. The lighting apparatus of claim 11, wherein the U-shape plates are disposed surrounding the driver.

15. The lighting apparatus of claim 14, wherein the second arm of one U-shape plate has a light source connector plugged to a driver connector of the driver for electrically connecting the LED modules on said one U-shape plate to the driver.

16. The lighting apparatus of claim 1, wherein the external switch comprises a rotation button for a user to rotate the rotation button to configure the working status of the driver.

17. The lighting apparatus of claim 1, wherein the external switch comprises a pressing button for a user to press the button to configure the working status of the driver.

18. The lighting apparatus of claim 1, wherein a back cover of the light housing has a first reflective layer for reflecting the light of the light source to the light passing cover, the first reflective layer has a central opening for placing the driver.

19. The lighting apparatus of claim 18, wherein the light housing has a lateral wall connected to a peripheral edge of the back cover, a second reflective layer is attached to an inner surface of the lateral wall.

* * * * *